United States Patent [19]

Deutsch

[11] Patent Number: 4,677,889

[45] Date of Patent: Jul. 7, 1987

[54] HARMONIC INTERPOLATION FOR PRODUCING TIME VARIANT TONES IN AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 791,631

[22] Filed: Oct. 25, 1985

[51] Int. Cl.[4] ..... G10H 1/06; G10H 7/00

[52] U.S. Cl. ..... 84/1.01; 84/1.22; 84/1.23

[58] Field of Search ..... 84/1.01, 1.22, 1.23

[56] References Cited

U.S. PATENT DOCUMENTS

| | | | |
|---|---|---|---|
| 4,205,575 | 6/1980 | Hoskinson et al. | 84/1.01 |
| 4,246,823 | 1/1981 | Wachi et al. | 84/1.22 |
| 4,269,101 | 5/1981 | Deutsch et al. | 84/1.01 |
| 4,344,343 | 8/1982 | Deforeit | 84/1.01 |

*Primary Examiner*—S. J. Witkowski

*Attorney, Agent, or Firm*—Ralph Deutsch

[57] ABSTRACT

A keyboard operated electronic musical instrument is disclosed which has a number of tone generators that are assigned to actuated keyswitches. Musical tones are produced by computing a master data set from an interpolated sequence of harmonic coefficient values. The master data set points are read out sequentially and repetitively from a memory and converted into an audible tone. A plurality of harmonic coefficient memories are used to store preselected sets of harmonic coefficients. In response to a timing clock, the harmonic coefficients from a cyclically chosen pair of harmonic coefficient memories are selected. A tone having a time variant spectra is produced by using a time variant interpolation between the selected pair of harmonic coefficients.

13 Claims, 5 Drawing Figures

HARMONIC INTERPOLATION FOR PRODUCING TIME VARIANT TONES IN AN ELECTRONIC MUSICAL INSTRUMENT

BACKGROUND OF THE INVENTION

1. Field of the Invention

This invention relates to musical tone synthesis and in particular is concerned with an improvement for producing tones having a time variant spectral content.

2. Description of the Prior Art

An elusive goal in the design of electronic keyboard operated musical instruments is the ability to realistically imitate the sounds of conventional acoustic type orchestral musical instruments. The best results have been obtalned for electronic musical instruments which imitate wind-blown pipe organs and harpsichords. The principal reason for obtaining good imitative results for these instruments is that they are essentially mechanical tone generators. The tone generation is entirely automatic and the musician only actuates on-off switches. With the notable exception of such instruments the tone character of almost all other acoustic musical instruments is a function of certain skills possessed by the musician.

It has long been recognized that with the possible exception of conventional organ tones, almost all tones produced by musical instruments exhibit tone spectra which are time variant. The recognition of the vital characteristic of time variant spectra has motivated the development of electrical musical tone generating systems such as those known by the generic names of "sliding formant" and "FM-synthesizer." Sliding formant tone generators constitute a class of generators which are also called subtractive synthesis. In subtractive synthesis, the fundamental tone source generates more than the ultimate desired tone spectral components and the undesirable spectral components are attenuated, or filtered out, by means of some variety of frequency filter. The FM-synthesizer is of the additive variety in that FM (frequency modulation) is used to add components to a source signal which frequently consists of a simple single frequency sinusoid time function.

The imitation of acoustic orchestral musical instruments using synthesis techniques such as the sliding format or FM-synthesizer has been one of trial and error. One adjusts a multiplicity of tone controls and ADSR envelope controls until an output tone is produced which is judged to be close or somewhat imitative of a particular musical instrument. Such techniques are in juxtaposition with the intuitive procedure in which one first analyzes the tones produced by a selected musical instrument. Based upon such an analysis an analytical model is postulated so that experimentally obtained parameters can be inserted into the analytical mode to synthesize tones that closely imitate the original tones.

The process of analysis, model generation, and synthesis for musical instrument sounds is obviously not an easily implemented procedure judging from the present lack of success except in a few relatively isolated instances. Part of the reason for the lack of success lies in the apparent inability to adequately generate an analytical model which includes many of the subtleties in tone structure imparted by the musician in an effective performance on his instrument. A musician commonly uses a playing technique such that the tonal structure for a given musical note varies with the loudness of the tone.

Repeated notes are played with different loudness and tonal structure and these somewhat subtle differences remove the mechanical-like repeated tones produced by most electronic musical tone generators. In general, as the tone level becomes louder, the tone spectra increases in the number and strength of the higher harmonics.

The simplest and most direct technique of imitating the sounds of acoustic musical instruments is to record the sounds on some suitable storage media and then play back the sounds upon demand initiated by keyboard switches. Such recording techniques have been implemented with various degrees of success for many years. Recently the availability of low cost microelectronic memories and the state-of-the-art digital signal processing techniques has led to the development of musical tone generators which have been given the somewhat misleading generic name of PCM (pulse code modulation). In these systems, the musical sound is digitized and stored in microelectronic memory circuits. Even with the comparatively low cost of such memory devices, the large amount of data storage required for a keyboard musical instrument having the capability of several different tones is still fairly excessive for most musical tone generation systems. A system of the PCM generic type is described in U.S. Pat. No. 4,383,462 entitled "Electronic Musical Instrument."

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted into musical waveshapes. A sequence of computation cycles is implemented during each of which a master data set is created. The master data set comprises a set of data points which define a period of a musical waveshape.

The master data set is computed by implementing a discrete Fourier-type transform operating on a sequence of interpolated harmonic coefficients: Preselected sets of harmonic coefficients are stored in a number of harmonic coefficient memories. A pair of harmonic coefficients is read out of harmonic memories that are selected in a cyclic order. An interpolation algorithm is used to form the sequence of interpolated harmonic coefficients. By varying the interpolation fraction in a time dependent manner, musical tones having a time variant spectra are produced.

BRIEF DESCRIPTION OF THE DRAWINGS

The detailed description of the invention is made with reference to the accompanying drawings wherein like numerals designate like components in the figures.

FIG. 3 is a schematic diagram of a tone generator.

DETAILED DESCRIPTION OF THE INVENTION

The present invention is directed toward a polyphonic tone synthesizer wherein time variant tones are produced by harmonic interpolation between prespecified sets of harmonic coefficients. The tone modification system is incorporated into a musical instrument of the type which synthesizes musical waveshapes by implementing a discrete Fourier transform algorithm. A tone generation system of this category is described in detail in U.S. Pat. No. 4,085,644 entitled "Polyphonic Tone Synthesizer." This patent is hereby incorporated by reference. In the following description all elements of the system which are described in the referenced patent are identified by two digit numbers which correspond to the same numbered elements appearing in the referenced patent.

Figure 1:
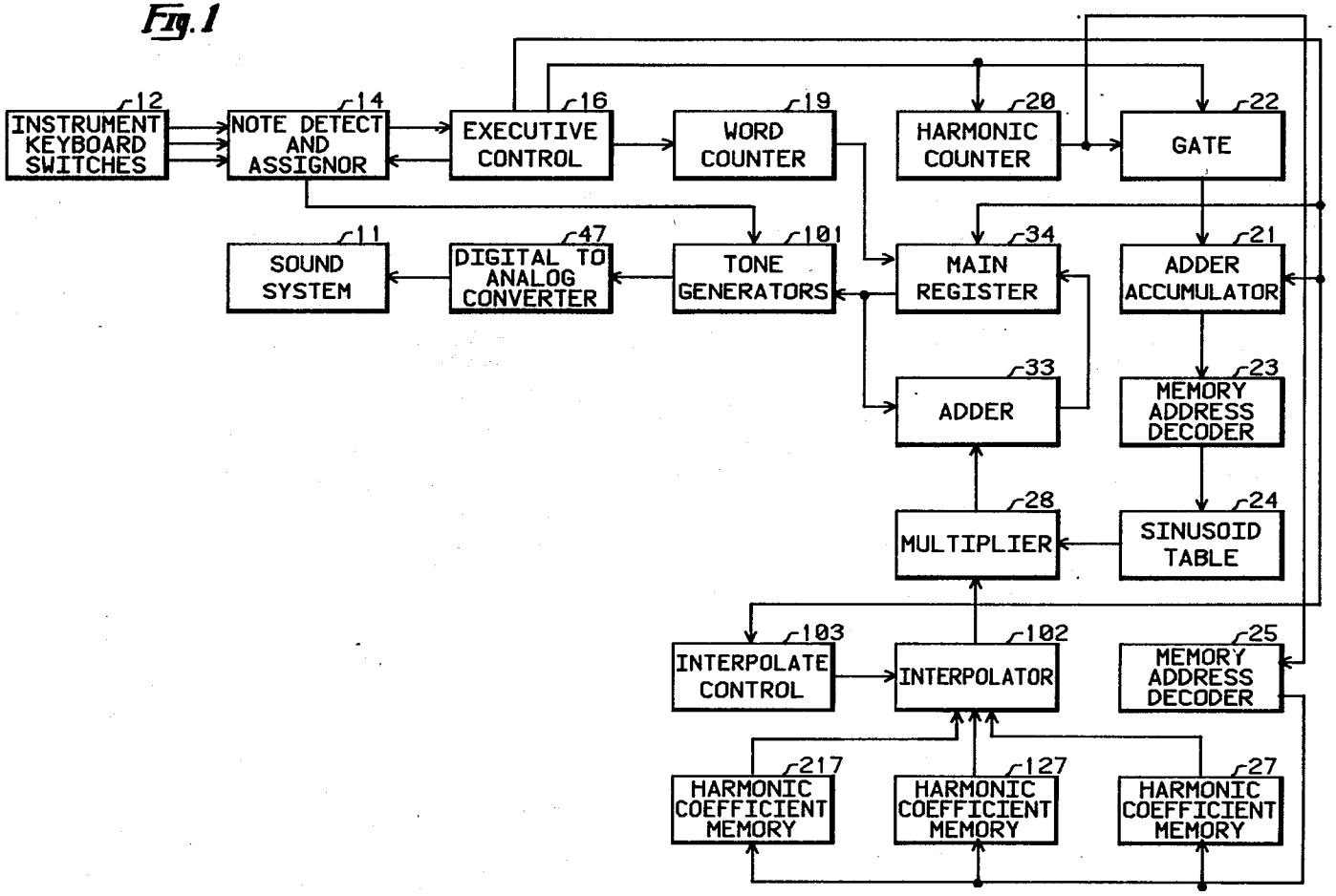
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of keyboard instrument switches 12. If one or more of the keyboard switches has a switch status change and is actuated ("on" switch position), the note detect and assignor 14 encodes the detected keyboard switch having the status change to an actuated state and stores the corresponding note information for the actuated keyswitches. One member of the set of tone generators, contained in the system block labeled tone generators 101, is assigned to each actuated keyswitch using the information generated by the note detect and assignor 14.

A suitable configuration for the note detect and assignor subsystem is described in U.S. Pat. No. 4,022,098 which is hereby incorporated by reference.

When one or more keyswitches have been actuated, the executive control 16 imitates a repetitive sequence of computation cycles. During each computation cycle, a master data set is computed. The 64 data words in a master data set correspond to the amplitudes of 64 equally spaced points of one cycle of the audio waveform for the musical tone produced by a corresponding one of the tone generators 101. The general rule is that the maximum number of harmonics in the audio tone spectra is no more than one-half of the number of data points in one complete waveshape period. Therefore, a master data set comprising 64 data words corresponds to a musical waveshape having a maximum of 32 harmonics.

It is desirable to be able to continuously recompute and store the generated master data sets during a repetitive sequence of computation cycles and to load this data into the note registers which are associated with each one of the tone generators in the block labeled tone generators 101 while the actuated keyswitches remain actuated, or depressed, on the keyboards.

In the manner described in the referenced U.S. Pat. No. 4,085,644 the harmonic counter 20 is initialized to its minimal, or zero, count state at the start of each computation cycle. Each time that the word counter 19 is incremented by the executive control 16 so that it returns to its initial, or minimal, count state because of its modulo counting implementation, a signal is.-generated by the executive control 16 which increments the count state of the harmonic counter 20. The word counter 19 is implemented to count modulo 64 which is the number of data words comprising the master data set. The harmonic counter 20 is implemented to count modulo 32. This number corresponds to the maximum number of harmonics consistent with a master data set comprising 64 data words.

At the start of each computation cycle, the accumulator in the adder-accumulator 21 is initialized to a zero value by the executive control 16. Each time that the word counter is incremented, the adder-accumulator 21 adds the current count state of the harmonic counter 20 to the sum contained in the accumulator. This addition is implemented to be modulo 64.

The content of the accumulator in the adder-accumulator 21 is used by the memory address decoder 23 to access the trigonometric sinusoid values from the sinusoid table 24. The sinusoid table 24 is advantageously implemented as a read only memory storing values of the trigonometric function $\sin(2\pi\theta/64)$ for $0 \leqq \theta \leqq 64$ at intervals of D. D is a table resolution constant.

The multiplier 28 is used to multiply the trigonometric function value read out from the sinusoid table 24 by an interpolated harmonic coefficient value furnished by means of the interpolator 102. The product value produced by this multiplication process is transferred to the adder 33.

The contents of the main register 34 are initialized to a zero value at the start of a computation cycle. Each time that the word counter 19 is incremented, the content of the main register 34, at an address corresponding to the count state of the word counter 19, is read out and furnished as an input to the adder 33. The sum of the input data to the adder 33 is stored in the main register 34 at a memory location equal, or corresponding, to the count state of the word counter 19. After the word counter 19 has been cycled for 32 complete cycles of 64 counts, the main register 34 will contain the master data set which comprises a complete period of a musical waveshape having a spectral function determined by the sequence of interpolated harmonic coefficient values provided by the interpolator 102.

Following each computation cycle in the repetitive sequence of computation cycles, a transfer cycle is initiated and executed. During a transfer cycle, in a manner described in the referenced U.S. Pat. No. 4,085,644, the master data set stored in the main register 34 is transferred into the note registers which are a component of each one of the tone generators contained in the system block labeled tone generators 101.

The master data set stored in each of the note registers is sequentially and repetitively read out in response to a note clock. The read out data is converted into an analog signal by means of the digital-to-analog converter 47. The resultant analog signal is transformed into an audible musical sound by means of the sound system 11. The sound system 11 contains a conventional amplifier and speaker combination for producing audible tones.

A plurality of harmonic coefficient memories, 27, 127, 227 are used to store set of harmonic coefficients. While only three such harmonic coefficient memories are shown explicitly in FIG. 1 it is understood that these are representative of a larger number of such memories. These memories are arranged in an numerical order corresponding to a set of increasing integer numbers. The memory address decoder simultaneously addresses out a harmonic coefficient from each of the plurality of harmonic coefficient memories at an address corresponding to the count state of the harmonic counter 20.

One of the functions of the interpolate control 103 is to select the harmonic coefficients addressed out from two consecutive harmonic coefficient memories selected in cyclic order. The interpolator 102 performs an interpolation calculation between the harmonic coefficients addressed out from the current selected two harmonic coefficient memories. If $c_q$ represents the q'th harmonic coefficient addressed from the first of the two selected harmonic coefficient memories and $d_q$ represents the corresponding q'th harmonic coefficient addressed out from the second of the two selected harmonic coefficient memories then the output data provided by the interpolator 102 is the interpolated harmonic coefficient $a_q$:

$$a_q = c_q + K(d_q - c_q) = (1-K)c_q + Kd_q \qquad \text{Eq. 1}$$

Figure 2:
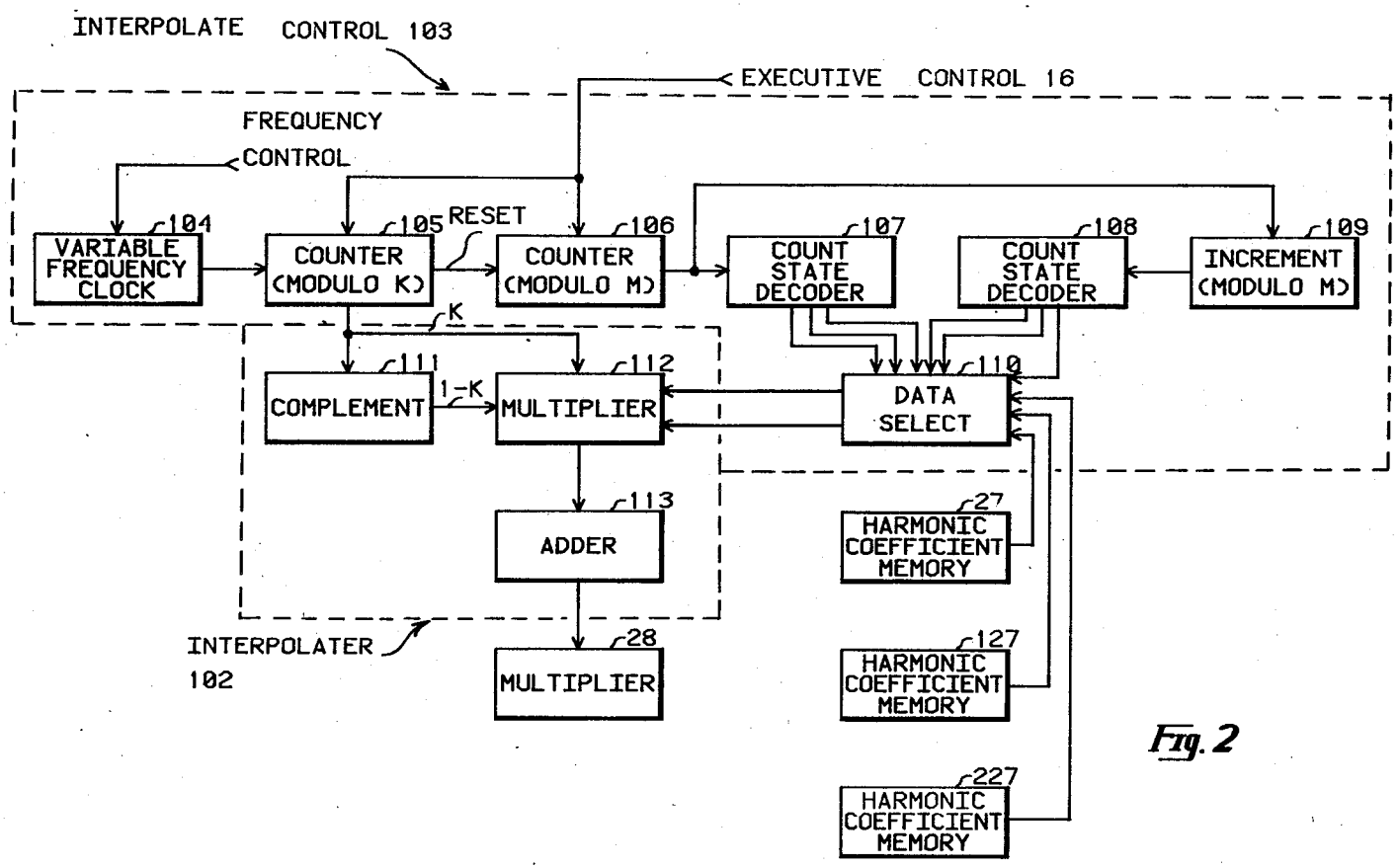
FIG. 2 is a schematic diagram of the interpolate control 103 and the interpolator 102.

FIG. 2 illustrates a system configuration for implementing the interpolation control 103 and the interpolator 102.

The variable frequency clock 14 is implemented as a variable. frequency timing source in which the frequency can be varied in response to the value of the frequency control signal.

The counter 105 counts the timing signals produced by the variable frequency clock 104 modulo a prespecified number K. The value of K determines the number of intervals for interpolation between two consecutive harmonic coefficients corresponding to the same harmonic numbers q. The count state of the counter 105 corresponds to the interpolation value K shown in Eq. 1.

Each time that the counter 105 returns to its zero, or minimal, count state because of its modulo K counting implementation, a RESET signal is generated. The counter 106 counts the RESET signals modulo a number M. M is equal to the number of harmonic coefficients memories shown symbolically by the harmonic coefficient memories 27, 127, and 227. The count state of the counter 106 is used to cyclically select the current pair of harmonic coefficient memories to be used in the interpolation calculation.

The count state decoder 107 decodes the binary count state of the counter 106 onto a set of count signal lines which are connected to the data select 110. The increment 109 adds one to the count state of the counter 106. This addition is implemented to be modulo M. This if the counter 106 is at its maximum count state, the output from the increment 109 will correspond to the next highest state in cyclic order, which in this case will correspond to the minimum count state of the counter 106.

The count state decoder 108 decodes the count state provided by the increment 109 onto a second set of count signal lines which are also connected to the data select 110. In response to the signals decoded onto the two sets of count signal lines, the data select 110 selects a harmonic coefficient read out from the harmonic coefficient memory corresponding to the count state of the counter 106 and selects a harmonic coefficient read out from the harmonic coefficient memory corresponding to the next highest count state of the counter 106.

The complement 111 performs a 1's complement to produce the value 1-K from the input binary value K which is the count state of the counter 105.

The first one of the two harmonic coefficients selected by the data select 110 is multiplied by K by means of the multiplier 112 and the output is furnished as one input to the adder 113. The second one of the two harmonic coefficients selected by the data select 110 is multiplied by the value 1-K by means of the multiplier 112 and the product value is furnished as a second input to the adder 113. The adder 113 sums the two input data values to produce an interpolated harmonic coefficient value which furnish as one of the data inputs to the multiplier 28.

At the start of each computation cycle, the count states of counter 105 and counter 106 are initialized to their minimal count states by means of a signal provided by the executive control 16.

FIG. 3 is a schematic diagram of one of the tone generators contained in the system block labeled tone generators 101. When the note detect and assignor 14 detects that a keyboard switch has been actuated, a corresponding frequency number is read from the frequency number memory 419. The frequency number memory 419 can be implemented as a read-only addressable memory (ROM) containing data words stored in binary numeric format having values $2^{-(M-N)/12}$ where N has the range of values N=1,2, . . , M and M is equal to the number of keyswitches on the musical instrument's keyboard. N designates the number of a keyboard switches which are numbered consecutively from "1" at the lowest keyboard tone switch. The frequency numbers represent the ratios of frequencies of generated musical tones with respect to the frequency of the system's logic clock. A detailed description of frequency numbers is contained in U.S. Pat. No. 4,114,496 entitled "Note Frequency Generator For A Polyphonic Tone Synthesizer." This patent is hereby incorporated by reference.

The frequency number read out of the frequency number memory 419 is stored in the frequency number latch 420. In response to timing signals produced by the logic clock 422, the frequency number contained in the frequency number latch 420 is successively added to the content of the accumulator contained in the adder-accumulator 421. The content of the accumulator is the accumulated sum of a frequency number.

During the transfer cycle associated with the tone generator shown explicitly in FIG. 3, the master data contained in the main register 34 is copied into the note register 35. In response to the six most significant bits of the accumulated frequency number contained in the adder-accumulator 421, data words are read out of the note register by the memory address decoder 423 and furnished to the digital-to-analog converter 47.

Figure 4:
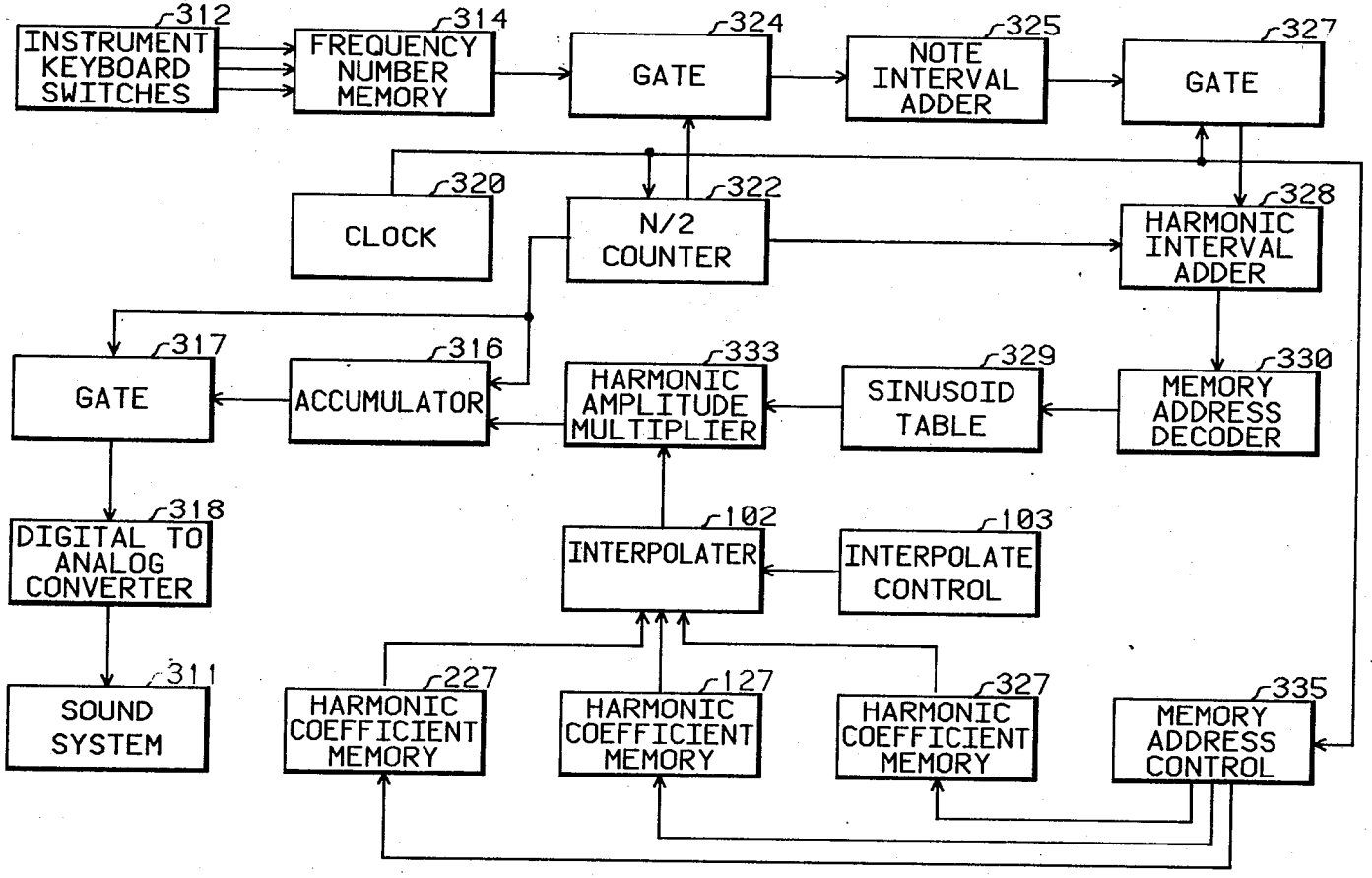
FIG. 4 is a schematic diagram of an alternate embodiment of the invention.
Figure 5:
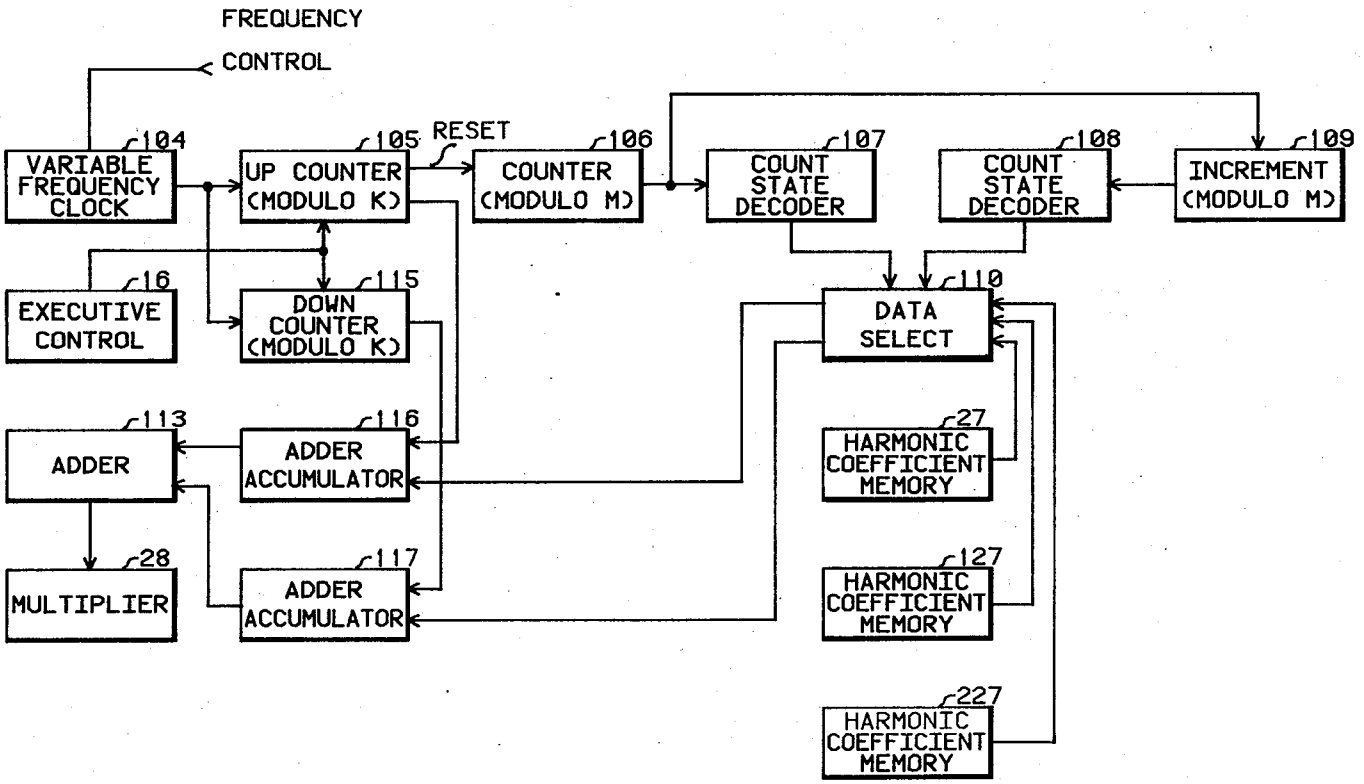

The present invention is not limited to a tone generation system of type described in the referenced U.S. Pat. No. 4,085,644. It can be used in conjunction with any tone generation system of the type in which waveshape data points are calculated by means of a discrete Fourier transform using stored sets of harmonic coefficients. One such tone generation system is described in U.S. Pat. No. 3,809,786 entitled "Computor Organ." This patent is hereby incorporated by reference. The system blocks in FIG. 4 which have numbers in the "300" numerical range are numbered to be 300 added to the block numbers shown in FIG. 1 of the referenced U.S. Pat. No. 3,809,786.

A closure of a keyswitch contained in the block labeled instrument keyboard switches 312 causes a corresponding frequency number to be accessed out of the frequency number memory 314. The frequency number transferred via gate 324 is repetitively added to the contents of the note interval adder 325 at a rate determined by the changes in the count state of the N/2 counter 322. The content of the note interval adder 325 specifies the sample point on a waveshape that is to be computed. For each such sample point, the amplitudes of a number of harmonic components are individually calculated by multiplying interpolated harmonic coefficients furnished by the interpolator 102 with trigonometric sinusoid function values read out from the sinusoid table 329. This multiplication is performed by means of the harmonic amplitude multiplier 333. The resultant harmonic component amplitudes are summed algebraically by means of the accumulator 316 to obtain the net amplitude at the waveshape sample point corresponding to the content of the note interval adder 325. The details of this calculation are described in the referenced U.S. Pat. No. 3,809,786.

Each waveshape sample point contained in the accumulator 316 is converted into an analog signal level by means of the digital-to-analog converter 318. The resultant analog signal is furnished to the sound system 311 which transforms the signal into an audible musical tone.

The harmonic interval counter 328 is initialized by a signal provided by the N/2 counter 322. In response to signals from the clock 320, the harmonic interval adder quccessively adds the content of the note interval adder 325 t6 the content of an accumulator. The memory address decoder 330 accesses a trigonometric function value from the sinusoid table 329 in response to the content of the harmonic interval adder.

In response to timing signals produced by the clock 320, the memory address control simultaneously reads out harmonic coefficient values from the plurality of harmonic coefficient memories 127, 227 and 327. These three memories represent a larger plurality of such harmonic coefficient memories. The interpolate control 103 and the interpolator 102 function in the manner previously described in reference to the system embodiment shown in FIG. 1.

Figure 5:
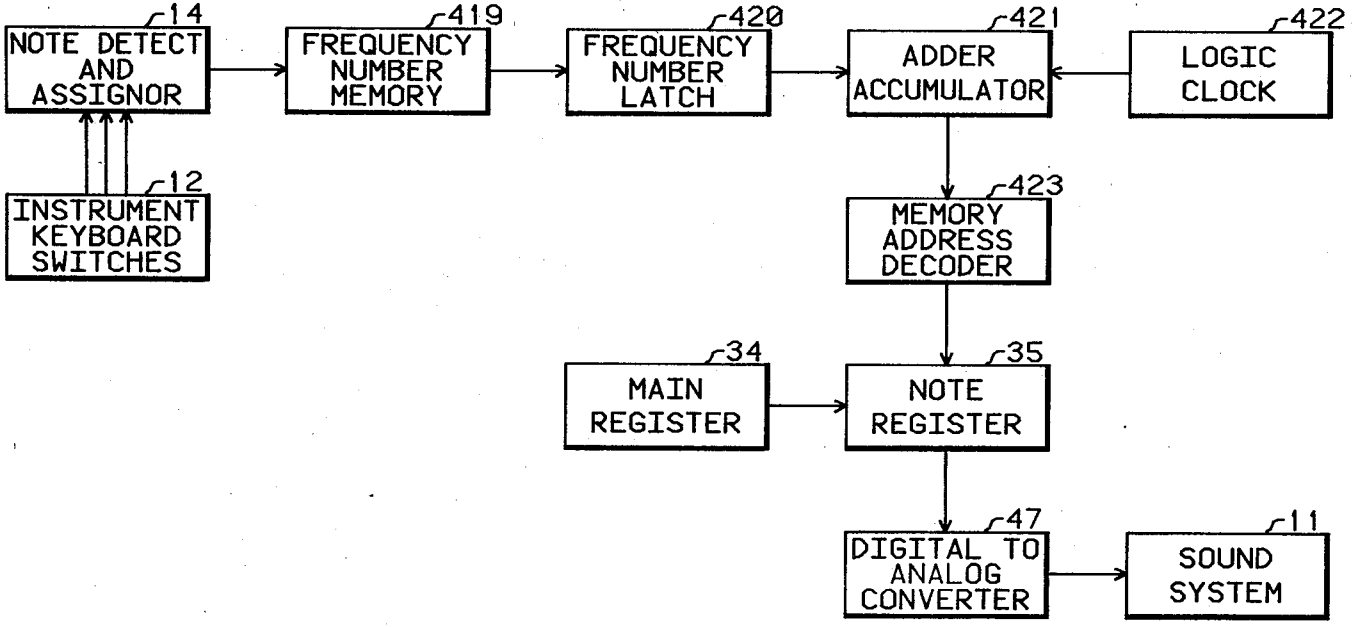
FIG. 5 is an alternate embodiment for harmonic coefficient interpolation.

FIG. 5 illustrates an alternative system logic for implementing the interpolator 102 which performs an interpolation between corresponding harmonic coefficients read out from two different harmonic coefficient memories. This system is intended for use in a tone generation system in which the harmonic coefficients are stored in the form of binary floating point numbers. A number A can be written in the following form as a binary floating point number.

$$A = 1.a_1a_2a_3 \times 2^p$$

where $a_1$, $a_2$, $a_3$ can assume the binary values of 0 or 1 and p is an integer. Since all numbers in this binary floating point form have a "1" to the left of the decimal point, it is not necessary to explicitly have this "1" in all the logic. It can readily be inserted by hard wired logic when the entire representation is explicitly needed. The number $a_1a_2a_3$ is called the mantissa and p is called the power of the binary floating point number.

In U.S. Pat. 4,144,789 entitled "Amplitude Generator For An Electronic Organ" a method is disclosed for employing a binary counter to simultaneously generate both the mantissa and power of a binary floating point number. This patent is hereby incorporated by reference. This binary counter is implemented as the up-counter 105 in FIG. 5.

The up-counter 105 is implemented as a counter having a word length of 7 bits. The three LSB (least significant bits) are used to form the mantissa $a_1a_2a_3$ and the four MSB (most significant bits) are used to form the power p. The leading "1" to the left of the decimal point for the corresponding binary floating point number is not explicitly represented by any of the up-down counter 105 bits. As the up-down counter 105 increases its count state in response to timing signals produced by the variable frequency clock 104, the count states represent the binary floating point numbers indicated by the entries in Table 1.

TABLE 1

| COUNT | MANTISSA | POWER | DECIMAL EQUIVALENT |
|---|---|---|---|
| 0000000 | 000 | 0000 | 1.000 |
| 0000001 | 001 | 0000 | 1.125 |
| 0000010 | 010 | 0000 | 1.250 |
| 0000011 | 011 | 0000 | 1.375 |
| 0000100 | 100 | 0000 | 1.500 |
| 0000101 | 101 | 0000 | 1.625 |
| 0000110 | 110 | 0000 | 1.750 |
| 0000111 | 111 | 0000 | 1.875 |
| 0001000 | 000 | 0001 | 2.00 |
| 0001001 | 001 | 0001 | 2.25 |
| 0001010 | 010 | 0001 | 2.50 |
| 0001011 | 011 | 0001 | 2.750 |
| 0001100 | 100 | 0001 | 3.00 |
| 0001101 | 101 | 0001 | 3.25 |
| 0001110 | 110 | 0001 | 3.50 |
| 0001111 | 111 | 0001 | 3.75 |
| 0010000 | 000 | 0010 | 4.00 |
| 0010001 | 001 | 0010 | 4.50 |
| 0010010 | 010 | 0010 | 5.00 |
| 0010011 | 011 | 0010 | 5.50 |
| 0010100 | 100 | 0010 | 6.00 |
| 0010101 | 101 | 0010 | 6.50 |
| 0010110 | 110 | 0010 | 7.00 |
| 0010111 | 111 | 0010 | 7.50 |
| 0011000 | 000 | 0011 | 8.00 |
| 0011001 | 001 | 0011 | 9.00 |
| 0011010 | 010 | 0011 | 10.00 |
| 0011011 | 011 | 0011 | 11.00 |
| 0011100 | 100 | 0011 | 12.00 |
| 0011101 | 101 | 0011 | 13.00 |

The down-counter 115 is also implemented to have 7 bits. It starts at a maximum count state and is decremented in response to the timing signals provided by the variable frequency clock 104. Table 2 lists some of the consecutive values of the binary floating point numbers corresponding to the count states of the down-counter 115. The power of the number is selected as 4 bits expressed in the form of a 2's complement binary number.

TABLE 2

| COUNT | MANTISSA | POWER | DECIMAL EQUIVALENT |
|---|---|---|---|
| 1111111 | 111 | 1111 | 0.9375 |
| 1111110 | 110 | 1111 | 0.875 |
| 1111101 | 101 | 1111 | 0.8125 |
| 1111100 | 100 | 1111 | 0.7500 |
| 1111011 | 011 | 1111 | 0.6875 |
| 1111010 | 010 | 1111 | 0.5625 |
| 1111001 | 001 | 1111 | 0.5625 |
| 1111000 | 000 | 1111 | 0.5000 |
| 1110111 | 111 | 1110 | 0.46875 |
| 1110110 | 110 | 1110 | 0.4375 |
| 1110101 | 101 | 1110 | 0.40625 |
| 1110100 | 100 | 1110 | 0.375 |
| 1110011 | 011 | 1110 | 0.34375 |
| 1110010 | 010 | 1110 | 0.3125 |
| 1110001 | 001 | 1110 | 0.28125 |
| 1110000 | 000 | 1110 | 0.250 |
| 1101111 | 111 | 1101 | 0.234375 |
| 1101110 | 110 | 1101 | 0.21875 |
| 1101101 | 101 | 1101 | 0.203125 |
| 1101100 | 100 | 1101 | 0.1875 |
| 1101011 | 011 | 1101 | 0.171875 |

TABLE 2-continued

| COUNT | MANTISSA | POWER | DECIMAL EQUIVALENT |
|---|---|---|---|
| 1101010 | 010 | 1101 | 0.15625 |
| 1101001 | 001 | 1101 | 0.140625 |
| 1101000 | 000 | 1101 | 0.12500 |
| 1100111 | 111 | 1100 | 0.1171875 |
| 1100110 | 110 | 1100 | 0.109375 |
| 1100101 | 101 | 1100 | 0.1015625 |

The data select 110 operates in the same fashion previously described for the system configuration shown in FIG. 2. It selects a harmonic coefficient read out from the harmonic coefficient memory associated with the output from the count state decoder and transfers the selected harmonic coefficient to the adder-accumulator 116. The adder accumulator sums the input data with the current count state of the down-counter 115. The harmonic coefficients are stored in the harmonic coefficient memories in the form of binary floating point numbers in which the "1" to the left of the decimal point has been suppressed.

The addition of binary floating point numbers is approximately equivalent to a multiplication of the numbers. For example, the decimal number $1=112$ is represented as the binary floating point number $1.110\times2^6$. This corresponds to a count state of 0110 110 because the power, 6, is written first. Suppose that the down-counter 115 has the count state 1110 010 corresponding to the decimal value 0.3125. Adding the two binary numbers 0110 110 and 1110 010 yields 0101 000 corresponding to the decimal number 32. This is an error of only 8.5% when compared to the true product value of $112\times0.3125=35$. Errors of this magnitude are of little or no consequence in a tone generation system.

The harmonic coefficients read out of the harmonic coefficient memory corresponding to the output from the count state decoder 108 are directed by the data select 110 to the adder-accumulator 116. The count state of the up-counter 105 is added to the content of the adder-accumulator 116. The net result is an approximation to the product of the harmonic coefficient and the binary floating point number corresponding to the count state of the up-counter 105.

The adder 113 sums the data content of the accumulators in the two adder-accumulators 116 and 117. This addition will require that the floating point be first converted to a binary fixed point form. The logic converting floating numbers to fixed point binary numbers is well-known in the computing art.

An advantage of the interpolation system shown in FIG. 5 is that no multipliers are required.

I claim:

1. In combination with a musical instrument in which a plurality of data words corresponding to the amplitudes of evenly spaced points defining the waveform of a musical tone are computed in a sequence of computation cycles from a preselected set of harmonic coefficients and are transferred sequentially and converted into musical waveshapes at a rate proportional to the pitch of the musical tone being generated, apparatus for producing musical tones having a time variant spectra comprising;

a plurality of harmonic coefficient memory means each storing a preselected set of harmonic coefficients, a waveshape memory means, a harmonic addressing means for simultaneously reading out a sequence of corresponding harmonic coefficients from each of said plurality of harmonic coefficient memory means, a harmonic coefficient select means whereby a subset of said sequence of harmonic coefficients read out from said plurality of harmonic coefficient memory means are selected, an interpolation means whereby a sequence of interpolated harmonic coefficient values is generated in response to said selected subset of said sequence of harmonic coefficients, a computing means responsive to said sequence of interpolated harmonic coefficient values whereby said plurality of data words corresponding to the amplitudes of evenly spaced points defining the waveshape of a musical tone are computed and stored in said waveshape memory means, a memory addressing means for reading out data words stored in said waveshape memory means at said rate proportional to the pitch of the musical tone being generated, and a conversion means whereby said data words read out of said waveshape memory means is converted into an anlog signal thereby producing said musical tone having a time variant spectra.

2. Apparatus according to claim 1 wherein said harmonic addressing means comprises;

a clock for providing timing signals, a word counter for counting said timing signals modulo the number of said plurality of data words corresponding to a period of said waveform of a musical tone, a harmonic counter incremented each time said word counter returns to its minimal count state, and a harmonic address decoder responsive to the count state of said harmonic counter whereby corresponding harmonic coefficients are simultaneously read out from each of said plurality of harmonic coefficient memory means.

3. Apparatus according to claim 1 wherein said computing means comprises;

an adder-accumulator means, comprising an accumulator, wherein the count state of said harmonic counter is successively added to the contents of said accumulator in response to said timing signals, a sinusoid table for storing a plurality of trigonometric sinusoid function values, an address decoder means responsive to the content of said accumulator whereby an address signal is generated, a sinusoid addressing means for reading out a trigonometric sinusoid function value from said sinusoid table in response to said address signal, and a master data set computing means responsive to said trigonometric sinusoid function value read out from said sinusoid table and to said sequence of interpolated harmonic coefficient values whereby said plurality of data words corresponding to the amplitudes of evenly spaced points defining the waveshape of a musical tone are computed and stored in said waveshape memory means.

4. Apparatus according to claim 1 wherein said plurality of harmonic coefficient memory means are arranged in a preselected numerical order corresponding to integer numbers in the range of 1 to W where W is the number of harmonic coefficient memory means in said plurality of harmonic coefficient memory means.

5. Apparatus according to claim 4 wherein said harmonic coefficient select means comprises;

an interpolation clock for providing interpolation timing signals, a first counter for counting said interpolation timing signals modulo a preselected number K, a second counter incremented each time said first counter returns to its minimal count state wherein said second counter counts modulo said number W, and a data select means responsive to the count state of said second counter wherein corresponding harmonic coefficients read out of two members of said plurality of harmonic coefficient memory means chosen in a pointwise cyclic order are selected to form said subset of harmonic coefficients.

6. Apparatus according to claim 3 wherein said data select means comprises;

an adder whereby the count state of said second counter is incremented by one count and wherein said adder adds modulo said number W, and a memory output select means whereby a harmonic coefficient is selected from the read out data from a harmonic coefficient memory means corresponding in numerical order to the count state of said second counter and whereby a harmonic coefficient is selected from the read out data from a harmonic coefficient memory means corresponding in numerical order to the incremented count state produced by said adder.

7. Apparatus according to claim 5 wherein said interpolation means comprises;

interpolation computation means responsive to the count state of said first counter whereby said interpolated harmonic coefficient value is computed from the harmonic coefficients selected by said data select means.

8. Apparatus according to claim 7 wherein said interpolation means comprises;

a complement means for forming the complement of the binary state of said first counter, a first multiplier means for multiplying the output from said complement means by the harmonic coefficient selected by said data select means from harmonic coefficients read out from selected first one of said plurality of harmonic coefficient memory means to form a first scaled harmonic coefficient value, a second multiplier means for multiplying the count state of said first counter by the harmonic coefficient selected by said data select means from the harmonic coefficients read out from the selected second one of said plurality of harmonic coefficient memory means to form a second scaled harmonic coefficient value, and an adder means wherein said interpolated harmonic coefficient value is generated in response to the sum of said first scaled harmonic coefficient value and said second scaled harmonic coefficient value.

9. In combination with a musical instrument in which a plurality of data words corresponding to the amplitudes of evenly spaced points defining the waveform of a musical tone are computed in a sequence of computation cycles from a preselected set of harmonic coefficients and are transferred sequentially and converted into musical waveshapes at a rate proportional to the pitch of the musical tone being generated, apparatus for producing musical tones having a time variant spectra comprising;

a plurality or harmonic coefficient memory means each storing a preselected set of harmonic coefficients in the form of binary floating point numbers, a waveshape memory means, a harmonic addressing means for simultaneously reading out a sequence of corresponding harmonic coefficients from each of said plurality of harmonic coefficient memory means, a harmonic coefficient select means whereby a subset of said harmonic coefficients read out from said plurality of harmonic coefficient memory means are selected, an interpolation means whereby an interpolated harmonic coefficient value is generated in response to said selected subset of harmonic coefficients, a computing means responsive to said sequence of interpolated harmonic coefficient values whereby said plurality of data words corresponding to the amplitudes of evenly spaced points defining the waveshape of a musical tone are computed and stored in said waveshape memory means, a memory addressing means for reading out data words stored in said waveshape memory means at said rate proportional to the pitch of the musical tone being generated, and a conversion means whereby said data words read out of said waveshape memory means is converted into an analog signal thereby producing said musical tone having a time variant spectra.

10. Apparatus according to claim 9 wherein said plurality of harmonic coefficient memory means are arranged in a preselected numerical order corresponding to integer numbers in the range of 1 to W where W is the number of harmonic coefficient memory means in said plurality of harmonic coefficient memory means.

11. Apparatus according to claim 10 wherein said harmonic coefficient select means comprises;

an interpolation clock for providing interpolation timing signals, a first counter for counting said interpolation timing signals modulo a preselected number K, a second counter incremented each time said first counter returns to its minimal count state wherein said second counter counts modulo said number W, and a data select means responsive to the count state of said second counter wherein corresponding harmonic coefficients read out of a first member and a second member of said plurality of harmonic coefficient memory means chosen in a pointwise cyclic order are selected to form said subset of harmonic coefficients.

12. Apparatus according to claim 11 wherein said interpolation means comprises;

a first adder for producing a first scaled harmonic coefficient by adding the count state of said first counter to a harmonic coefficient read out from said first selected member of said plurality of harmonic coefficient memory means which is selected by said data select means, a third counter decremented by said interpolation timing signals and which counts modulo said number K which is the maximum count state of said third counter, a second adder for producing a second scaled harmonic coefficient by adding the count state of said third counter to the harmonic coefficient read out from said second selected member of said plurality of harmonic codfficient memory means which is selected by said data select means, and a third adder means wherein said interpolated harmonic coefficient value is generated in response to the sum of said first scaled harmonic coefficient value and said second scaled harmonic coefficient value.

13. In combination with a musical instrument in which a plurality of data words corresponding to the amplitudes of points defining the waveform of a musical tone are computed from a preselected set of harmonic coefficients at regular time intervals and converted into musical tones, apparatus for producing musical tones having a time variant spectra comprising;

a plurality of harmonic coefficient memory means each storing a preselected set of harmonic coefficients, harmonic addressing means for simultaneously reading out a sequence of corresponding harmonic coefficients from each of said plurality of harmonic coefficient memory means, a harmonic coefficient select means whereby a subset of said harmonic coefficients read out from said plurality of harmonic coefficient memory means are selected, an interpolation means whereby an interpolated harmonic coefficient value is generated in response to said selected subset of harmonic coefficients, a means for computing responsive to each said interpolated harmonic coefficient value whereby said amplitudes of points defining the waveform of said musical tone are computed, and a means for producing a musical tone from said amplitudes of points.

* * * * *